US009045315B2

(12) United States Patent
Arzberger et al.

(10) Patent No.: US 9,045,315 B2
(45) Date of Patent: Jun. 2, 2015

(54) CONSTRUCTION MACHINE

(71) Applicant: BAUER MASCHINEN GMBH, Schrobenhausen (DE)

(72) Inventors: Maximilian Arzberger, Igenhausen (DE); Andreas Christoph Benjamin Schuell, Gerolsbach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 13/946,462

(22) Filed: Jul. 19, 2013

(65) Prior Publication Data

US 2014/0027399 A1 Jan. 30, 2014

(30) Foreign Application Priority Data

Jul. 24, 2012 (EP) ..... 12005397

(51) Int. Cl.
*B66C 23/70* (2006.01)
*B66C 15/00* (2006.01)
*B66C 23/88* (2006.01)

(52) U.S. Cl.
CPC ..... *B66C 15/00* (2013.01); *B66C 23/88* (2013.01)

(58) Field of Classification Search
USPC ..... 212/291, 271, 177, 294, 299, 347; 182/3, 8, 12, 36, 37, 39
See application file for complete search history.

(56) References Cited

U.S. PATENT DOCUMENTS

| | | | | |
|---|---|---|---|---|
| 4,607,724 | A * | 8/1986 | Hillberg | 182/3 |
| 4,880,491 | A * | 11/1989 | Jacobs et al. | 156/763 |
| 5,297,651 | A * | 3/1994 | Vandelinde | 182/3 |
| 5,522,472 | A * | 6/1996 | Shuman et al. | 182/3 |
| 6,092,623 | A * | 7/2000 | Collavino | 182/3 |
| 6,148,580 | A * | 11/2000 | Weir | 52/651.1 |
| 6,273,844 | B1 * | 8/2001 | Kelsey et al. | 482/54 |
| 7,044,315 | B2 * | 5/2006 | Willim | 212/299 |
| 7,073,457 | B2 * | 7/2006 | Boatman | 114/230.15 |
| 7,207,414 | B2 * | 4/2007 | Luke et al. | 182/3 |
| 7,341,159 | B2 * | 3/2008 | Nelson | 212/285 |
| 2004/0050620 | A1 * | 3/2004 | Luke et al. | 182/45 |
| 2005/0192732 | A1 * | 9/2005 | Narisawa et al. | 701/50 |
| 2008/0173607 | A1 * | 7/2008 | Duncan | 212/271 |
| 2011/0315649 | A1 | 12/2011 | Neuffer | |
| 2012/0241404 | A1 * | 9/2012 | Bobeck | 212/300 |

FOREIGN PATENT DOCUMENTS

| | | | |
|---|---|---|---|
| CN | 2474507 | Y | 1/2002 |
| CN | 201988079 | U | 9/2011 |
| DE | 102009018689 | A1 | 11/2009 |
| DE | 102010025481 | A1 | 12/2011 |
| DE | 202012003638 | U1 | 5/2012 |
| EP | 2402282 | A1 | 1/2012 |
| JP | H10-218569 | A | 8/1998 |

OTHER PUBLICATIONS

The extended European search report issued on Oct. 31, 2012, which corresponds to EP12005397.0 and is related to U.S. Appl. No. 13/946,462.

* cited by examiner

*Primary Examiner* — Emmanuel M Marcelo
(74) *Attorney, Agent, or Firm* — Studebaker & Brackett PC

(57) ABSTRACT

The invention relates to a construction machine having a carrier unit, a boom mounted pivotably on the carrier unit, an erection support for erecting and/or holding the boom by means of a guy cable tensioned between the boom and the erection support, and a safety cable which can be tensioned along the boom for securing a user. A cable support with a first attachment point for the safety cable is arranged at a head end of the boom. A second attachment point for the safety cable is provided on the erection support. The safety cable can be tensioned between the first attachment point on the cable support and the second attachment point on the erection support along the boom.

11 Claims, 3 Drawing Sheets

CONSTRUCTION MACHINE

The invention relates to a construction machine according to the preamble to claim 1.

The construction machine comprises a carrier unit, a boom mounted pivotally on the carrier unit, an erection support for erecting and/or holding the boom by means of a guy cable tensioned between the boom and the erection support and a safety cable which can be tensioned along the boom to secure a user.

In order to control, assemble or execute repair works it is frequently necessary to walk-on the boom of such a construction machine. For this purpose, the boom is hereby usually brought into a lying or horizontal position so that a user can move on an upper side of the boom.

DE 10 2009 018 689 A1 discloses a boom element with two support struts which can be folded out, between which a safety cable can be tensioned to secure a user. The user can be suspended in the safety cable via a safety karabiner for fall prevention.

A further securing device for securing persons when accessing a crane boom is known from DE 10 2010 025 481 A1. Rails are arranged on the longitudinal sides of a grating on the boom, in which rails sliding elements are guided which can be connected to a safety belt of the user.

It is an object of the invention to indicate a construction machine with a reliable and at the same time easy-to-use fall prevention means.

The object is achieved according to the invention through a construction machine having the features of claim 1. Preferred embodiments are indicated in the dependent claims.

It is provided according to the invention that a cable support with a first attachment point for the safety cable is arranged at a head end of the boom, that a second attachment point for the safety cable is provided on the erection support, and that the safety cable can be tensioned between the first attachment point on the cable support and the second attachment point on the erection support along the boom.

A first core idea of the invention can be seen in providing a securing facility for a user which facilitates securing essentially along the whole length of the boom. The safety cable is for this purpose tensioned between the head-side end of the boom and the erection support which is usually attached to the carrier unit. In order to tension the safety cable along the boom, merely a single attachment point is thus required on the boom itself. This is provided on a cable support at the head end of the boom. The opposite end of the safety cable is fixed to the erection support which—as also the boom—is usually pivotally mounted on the carrier unit. The tensioning of the safety cable can thus be managed particularly simply by pivoting the erection support.

The safety cable tensioned between the erection support and the cable support at the head end of the boom additionally offers the advantage that possibly present boom elements, of which the boom may be composed, do not each have to have individual fixing means for the safety cable. The boom or the individual boom elements can therefore be produced particularly cost-effectively.

The manageability of the fall prevention means can be further improved according to the invention by a cable winch being arranged on the erection support and/or on the cable support for receiving and/or tensioning the safety cable. The safety cable can be wound during the working operation of the construction machine onto the cable winch and is thus securely held. In order to provide fall prevention means, the cable can be wound from the cable winch and fixed to the opposing attachment point. The cable winch additionally facilitates a simple tensioning of the safety cable.

The cable support can be adjustable in a preferred embodiment of the invention between a securing position and a retracted position. In the securing position the cable support is orientated so that the safety cable can be tensioned parallel to the longitudinal axis of the boom between the two attachment points. The cable support hereby projects, when the boom is lying, upwards in relation to the boom. In the retracted position, the cable support is preferably arranged at least partially within the cross-section of the boom so that it does not impair the regular operation of the construction machine.

It is particularly preferable that the cable support is attached pivotably to the head end of the boom. The cable support can preferably be pivoted between a projecting securing position and a retracted position. In the projecting securing position the cable support preferably projects in relation to the cross-section of the boom, while in the retracted position it is arranged at least extensively within the boom cross-section.

It is preferred according to the invention for the cable support to project in the securing position, when the boom is lying, upwards in relation to the boom, and to extend in the retracted position into a side axial region beside the head end of the boom. With reference to an erected boom this means that the cable support projects in the securing position laterally in relation to the boom and extends in the retracted position into a region above the head end of the boom. It is thus possible for the safety cable to be tensioned over the whole boom, while the safety cable is kept securely above the boom in regular working operation of the construction machine.

It is particularly advantageous if the cable support extends in the securing position, preferably also in the retracted position, starting from its attachment point, away from the attachment point of the boom on the carrier unit—the boom base. The force of the safety cable can hereby be introduced particularly favourably into the boom.

According to the invention it is further preferable for the safety cable to be guided in the retracted position of the cable support via a deflection means on the boom. The deflection means is arranged particularly advantageously so that the cable support can be raised through a pulling force transmitted via the safety cable, when the boom is lying, based on the retracted position and in particular can be conveyed into the security position.

Accordingly it is particularly preferable for the cable support to be pivotable by means of the safety cable between the securing position and the retracted position. In particular, it is hereby to be understood that the cable support can be pivoted by means of a pulling force of the safety cable. The pulling force of the safety cable can be produced for example by pivoting the erection support and/or by activating the cable winch.

According to a further preferred embodiment it is provided that the safety cable can be tensioned in the securing position of the cable support against a stop. The cable support is for this purpose attached to the boom in such a way that it extends, starting from its attachment point, in the direction of the boom tip or away from the boom base. The stop can be fixed or adjustable. In order to provide adequate cable tensioning, a tensioning means is provided. Alternatively or additionally, the cable support can be locked in the securing position and/or the retracted position. The cable support is preferably made of metal.

In order to tension the safety cable it is preferable for the safety cable to be tensionable by activating the cable winch and/or raising the erection support. A particularly powerful cable tensioning can hereby be achieved.

In order to protect the user, even without the safety cable being tensioned, for example before the assembly or after the disassembly thereof, it is preferable for at least one attachment point for a suspension cable for direct connection to the user to be present on the erection support. The user can secure himself with the suspension cable, which is fixed for example to a safety belt of the user, directly to the erection support.

The invention is further explained below using a preferred embodiment which is shown in the attached schematic drawings, in which.

The same components or those having the same effect have the same reference symbols in all the figures.

Figure 1:
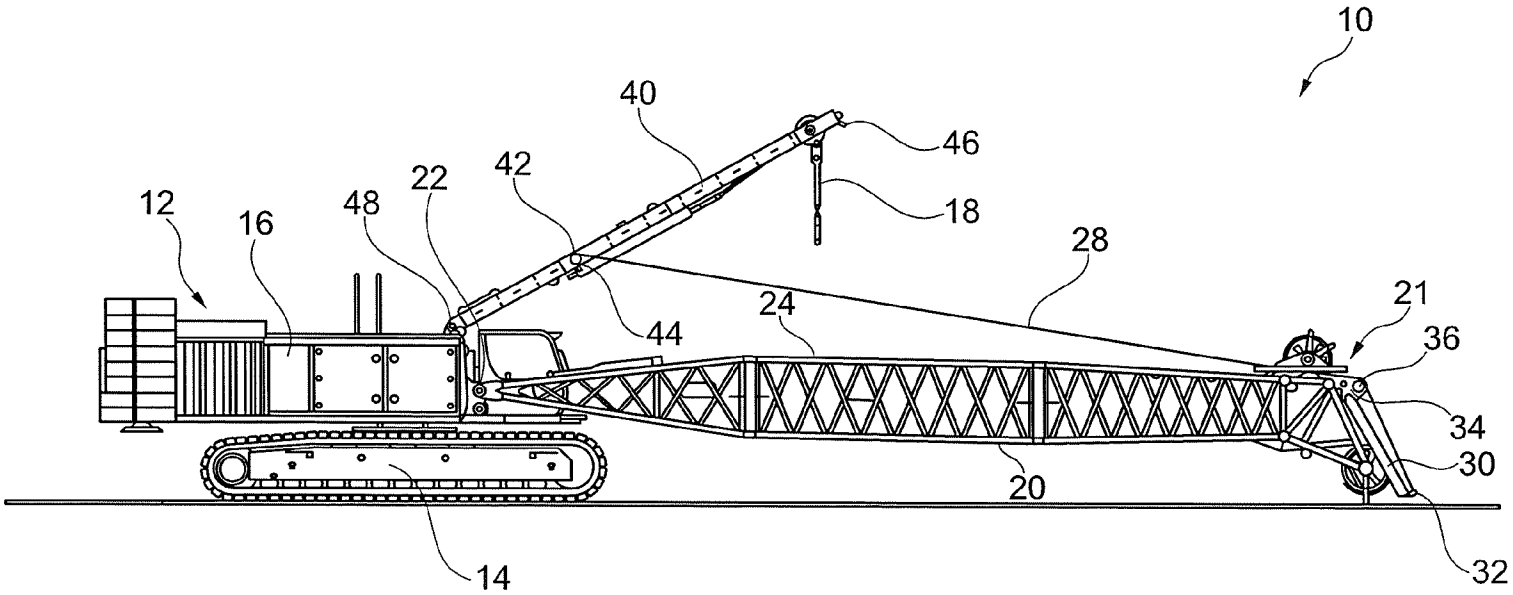
FIG. 1 shows a construction machine according to the invention with a cable support in a retracted position.

A construction machine 10 according to the invention comprises a carrier unit 12 with an undercarriage 14 and an upper structure 16 which is rotationally mounted on the undercarriage 14 about a vertical rotation axis. A boom 20 is mounted on the upper structure 16 so that it can be pivoted about a horizontal boom pivot axis 22. The grating-like boom 20 can be pivoted between a substantially horizontal lowered or lying position, which is shown in the figures, and an erected operating position (not shown). In the lying position of the boom 20 a longitudinal axis of the boom 20 extends approximately horizontally. The end of the boom 20, lying opposite the boom pivot axis 22, which is also described as the head end 21 of the boom 20, forms a lateral longitudinal end of the boom 20 in the lying position of the boom 20.

In order to erect and/or hold the boom 20, an erection support 40 is provided which is mounted on the upper structure 16 so as to be pivotable about an erection support pivot axis 48. A guy cable 18 can be tensioned between the boom 20 and the erection support 40, of which guy cable merely a cable end is shown in the figures. A further guy cable can be tensioned between the erection support 40 and the carrier unit 12.

The boom 20 comprises, in the lowered position, an upper side face 24, which can be accessed by a user for maintenance or assembly purposes. For this purpose, grating can for example be arranged on the corresponding side face 24, whereby persons can walk on said grating.

In order to secure the user walking on the side face 24 of the boom 20, a safety cable 28 is tensioned above and along the boom 20. The safety cable 28 is fixed on the one hand to a cable fixed point and on the other hand wound onto a cable winch 42. The cable fixed point is located on a cable support 30 which is pivotally mounted on the boom 20. The rotationally mounted cable winch 42 for receiving the safety cable 28 is mounted on the erection support 40. In principle the cable winch 42 could, however, also be provided on the cable support 30 and the cable fixed point on the erection support 40.

Figure 2:
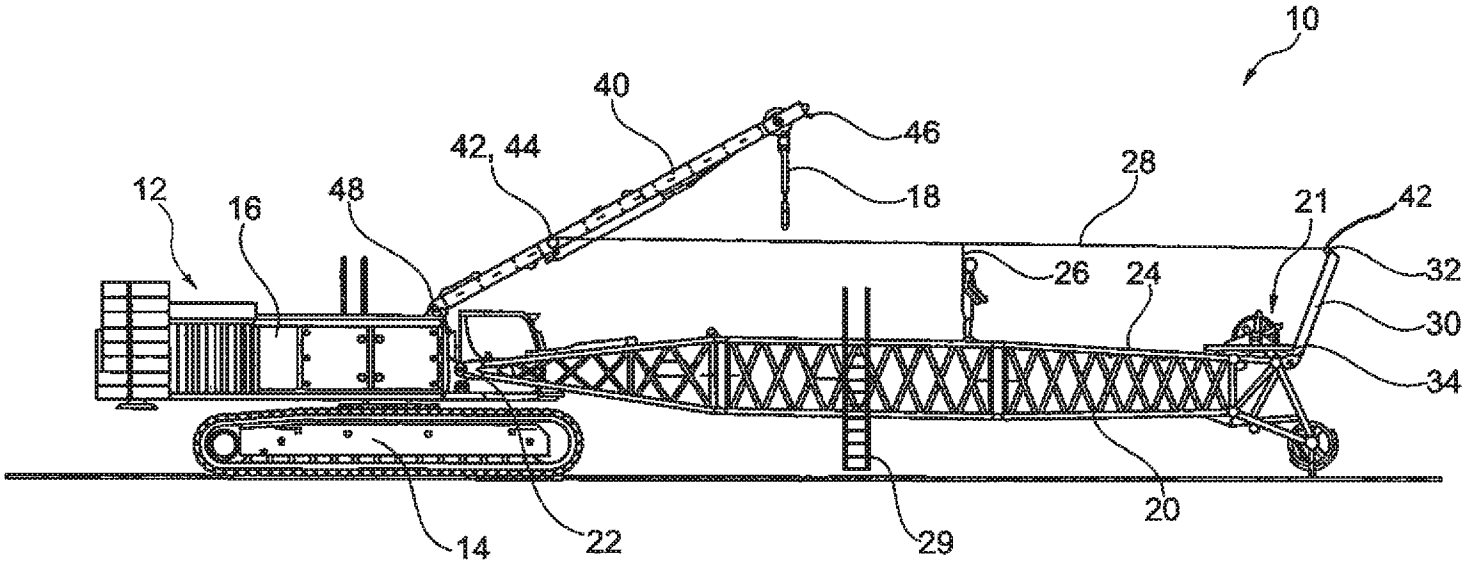
FIG. 2 shows a construction machine according to the invention with a cable support in a securing position and FIG. 3 shows a construction machine according to the invention with a user secured directly on an erection support.
Figure 3:
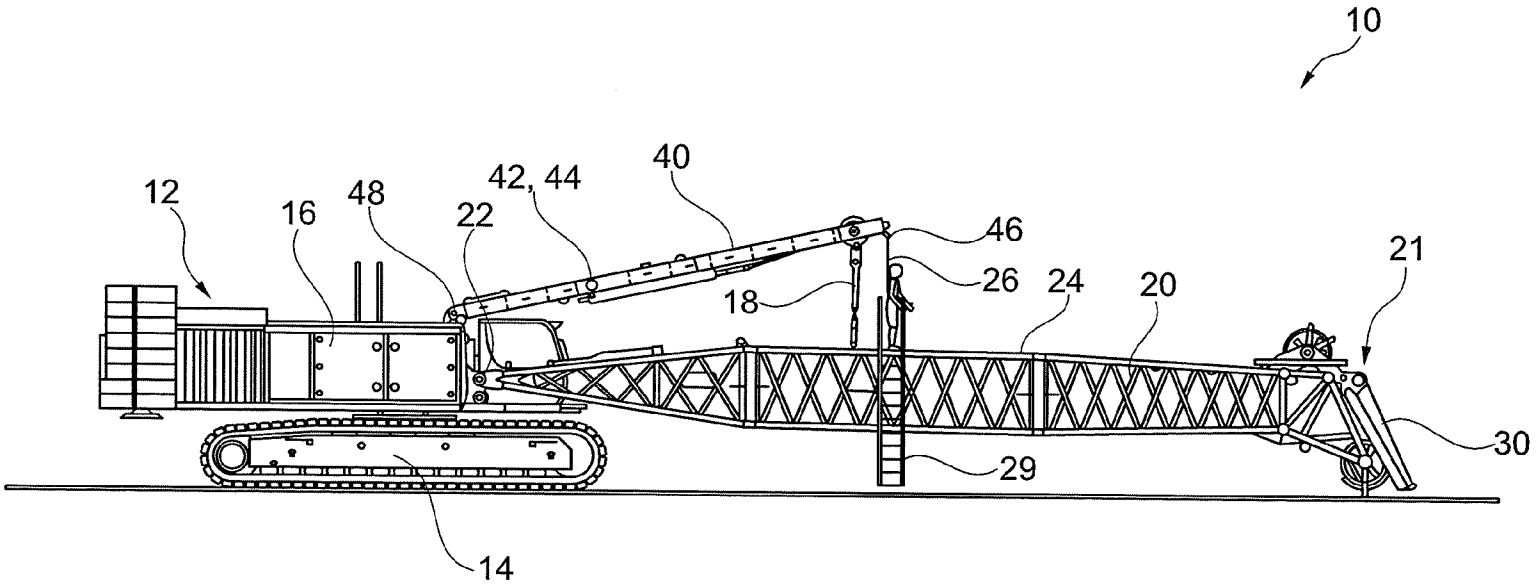

The fixing point of the safety cable 28 on the cable support 30 forms a first attachment point 32 for the safety cable 28. The cable winch 42 forms a second attachment point 44. The cable support 30 is arranged at the head end 21 of the boom 20 and can be pivoted between a lowered retracted position, as shown in FIGS. 1 and 3, and a securing position, as shown in FIG. 2.

The cable support 30 is attached to the head end 21 at the height of the upper side face 24 of the boom 20 and extends in the lowered retracted position from its pivot axis 34, in particular inclined, downwards, in particular in a direction facing away from the boom base. The cable support 30 is thus located, in the lowered position of the boom 20, laterally beside the boom 20.

In its securing position (FIG. 2) the cable support 30 is upwardly pivoted in relation to the retracted position and extends from the pivot axis 34 in an inclined manner upwards, preferably in a direction facing away from the boom base.

The attachment point 32 for the safety cable 28 on the cable support 30 is located on an end region lying opposite the pivot axis 34, said end region being accessible in the lowered retracted position of the cable support 30 by a user on the ground. The safety cable 28 can thus be fixed to the cable support 30 without danger by a user on the ground. In order to produce the securing position, a pulling force is transferred to the safety cable 28 at the second attachment point 44 by rotating the cable winch 42 and/or erecting the erection support 40, said pulling force erecting the cable support 30. The safety cable 28 can thus be erected very simply and without danger.

The safety cable 28 is guided in the retracted position of the cable support 30 via a deflecting means 36, for example a deflection roller. This is arranged offset relative to the pivot axis 34 of the cable support 30 so that the cable support 30 can be pivoted by means of a pulling force of the safety cable 28.

A ladder 29 is fixed to the boom 20, via which ladder 29 the user can access the upper side 24 of the boom 20. By means of a suspension cable 26, which can be fixed to a safety belt of the user, he can hang in the safety cable 28 and thus protect himself from falling from the boom 20. Alternatively, he can hang with the suspension cable 26 directly at an attachment point 46 on the erection support 40 in order to secure himself, even without a safety cable, on the boom 20, as shown in FIG. 3.

The safety cable 28 can be set up as follows: The foldable cable support 30, which is located on the boom head, with the cable fixed point, is initially folded forwards and downwards due to its own weight without the tensioned safety cable 28. The safety cable 28 is suspended at the fixed point and guided via the deflection means 36 in the region of the rotation axis 34 of the cable support 30 to the cable winch 42 on the erection support 40. The erection support 40 is pulled up and/or the securing cable winch 42 is activated. The cable support 30, which can also be described as a folding support, is hereby erected, and the safety cable 28 is tensioned over the whole boom length.

All in all, the construction machine according to the invention constitutes a simple to set up and activate and at the same time reliable fall prevention means for a user moving on a lying boom fixed to a carrier unit.

The invention claimed is:

1. Construction machine with a carrier unit, a boom mounted pivotably on the carrier unit, an erection support mounted on the carrier unit for erecting or holding the boom by means of a guy cable tensioned between the boom and the erection support and a safety cable for securing a user which can be tensioned along the boom, wherein a cable support with a first attachment point for the safety cable is arranged at a head end of the boom, a second attachment point for the safety cable is provided on the erection support, and the safety cable can be tensioned between the first attachment point on the cable support and the second attachment point on the erection support along the boom.

2. Construction machine according to claim 1, wherein a cable winch is arranged on at least one of the erection support and the cable support for tensioning the safety cable.

3. Construction machine according to claim 1,
wherein
the cable support is pivotably attached to the head end of the boom.

4. Construction machine according to claim 1,
wherein
the cable support can be adjusted between a securing position and a retracted position.

5. Construction machine according to claim 4,
wherein
the cable support projects in the securing position, when the boom is lying, upwards in relation to the boom and extends, in the retracted position, into a lateral axial region beside the head end of the boom.

6. Construction machine according to claim 4,
wherein
the safety cable is guided in the retracted position of the cable support via a deflection means on the boom.

7. Construction machine according to claim 4,
wherein
the cable support can be pivoted by means of the safety cable between the securing position and the retracted position.

8. Construction machine according to claims 4,
wherein
the securing cable can be tensioned in the securing position of the cable support against a stop.

9. Construction machine according to claim 1,
wherein
the safety cable can be tensioned by activating a cable winch or raising the erection support.

10. Construction machine according to claim 1,
wherein
at least one attachment point for a suspension cable is available on the erection support for direct connection to the user.

11. Construction machine according to claim 1,
wherein
said boom is pivotably mounted on the carrier unit via a first pivot axis thereof and said erection support is pivotably mounted on the carrier unit via a second pivot axis thereof wherein the first pivot axis is positioned different from the second pivot axis on the carrier unit.

* * * * *